US009309701B2

(12) United States Patent
Jeffries

(10) Patent No.: US 9,309,701 B2
(45) Date of Patent: Apr. 12, 2016

(54) SLAM LATCH FOR TOOLBOX

(75) Inventor: Mark Jeffries, Buford, GA (US)

(73) Assignee: Austin Hardware And Supply, Inc., Lee's Summit, MO (US)

( * ) Notice: Subject to any disclaimer, the term of this patent is extended or adjusted under 35 U.S.C. 154(b) by 471 days.

(21) Appl. No.: 12/134,573

(22) Filed: Jun. 6, 2008

(65) Prior Publication Data

US 2009/0301146 A1 Dec. 10, 2009

(51) Int. Cl.

| | |
|---|---|
| ***E05C 9/10*** | (2006.01) |
| ***E05C 9/08*** | (2006.01) |
| ***B25H 3/02*** | (2006.01) |
| *E05C 5/02* | (2006.01) |
| *E05B 5/00* | (2006.01) |
| *E05B 15/02* | (2006.01) |

(52) U.S. Cl.
CPC .. *E05C 9/08* (2013.01); *B25H 3/02* (2013.01); *E05B 5/00* (2013.01); *E05B 2015/023* (2013.01); *Y10T 70/5549* (2015.04); *Y10T 70/5558* (2015.04)

(58) Field of Classification Search
CPC ..... E05C 9/08; E05B 5/00
USPC ..... 292/4, 5, 7, 44, 50, 52, 54, 57, 59, 63, 292/69, 200, DIG. 11
See application file for complete search history.

(56) References Cited

U.S. PATENT DOCUMENTS

| | | | | |
|---|---|---|---|---|
| 197,115 | A | 11/1877 | Frees | |
| 307,257 | A | 10/1884 | Bacon | |
| 695,736 | A | 3/1902 | Kendrick | |
| 872,099 | A | 11/1907 | Wolff | |
| 934,153 | A | 9/1909 | Flowers | |
| 1,100,820 | A | 6/1914 | Edwards | |
| 1,348,715 | A | 8/1920 | Grending | |
| 1,597,079 | A | 8/1926 | Griffin | |
| 1,628,506 | A | 5/1927 | Lyman | |
| 1,809,720 | A * | 6/1931 | Mears et al. | 292/52 |
| 1,820,238 | A | 8/1931 | Mears et al. | |
| 1,860,910 | A * | 5/1932 | Taylor | 292/87 |

(Continued)

FOREIGN PATENT DOCUMENTS

| | | |
|---|---|---|
| CA | 2291941 A1 | 10/2000 |
| DE | 1 428 570 | 12/1968 |

(Continued)

OTHER PUBLICATIONS

U.S. Appl. No. 14/072,128 Office Action mailed Apr. 8, 2015 (7 pages).

(Continued)

*Primary Examiner* — Carlos Lugo
(74) *Attorney, Agent, or Firm* — Polsinelli PC

(57) ABSTRACT

A slam type locking mechanism is described. The locking mechanism allows a storage container with the locking mechanism to be slammed shut in a single motion. The operator may slam the lid or door to the container using a single hand that is only pressing or pushing the lid or door closed. The slam type locking mechanism includes a lock having a lock housing, a paddle handle, and a spring loading mechanism. The paddle handle is rotatably engaged to the spring loading mechanism. The rods are in a rotational engagement with the lock, wherein the rods have an offset that interacts with a striker on the container or lid in a locking relationship.

25 Claims, 5 Drawing Sheets

(56) References Cited

U.S. PATENT DOCUMENTS

| | | | | | |
|---|---|---|---|---|---|
| 1,865,778 | A | * | 7/1932 | Mears et al. | 292/217 |
| 1,905,814 | A | | 4/1933 | De Orlow | |
| 1,926,102 | A | | 9/1933 | Keeler | |
| 1,934,137 | A | | 11/1933 | Moore | |
| 1,950,686 | A | | 3/1934 | Moore | |
| 2,041,447 | A | * | 5/1936 | Woody | 292/7 |
| 2,126,141 | A | | 8/1938 | Saunders | |
| 2,172,169 | A | * | 9/1939 | Claud-Mantle | 70/82 |
| 2,183,621 | A | | 12/1939 | Peterson | |
| 2,218,683 | A | | 10/1940 | Miller | |
| 2,327,735 | A | * | 8/1943 | Neunherz | 292/4 |
| 2,534,693 | A | | 12/1950 | Adams | |
| 2,837,363 | A | | 6/1958 | Eichner | |
| 2,839,912 | A | | 6/1958 | Corbin | |
| 2,843,886 | A | | 7/1958 | Rundberg | |
| 2,992,031 | A | | 7/1961 | Herbert | |
| 3,026,131 | A | | 3/1962 | Herbert | |
| 3,596,952 | A | | 8/1971 | Hinkle et al. | |
| 3,809,414 | A | * | 5/1974 | Neunherz et al. | 292/4 |
| 3,834,780 | A | | 9/1974 | McClellan et al. | |
| 3,965,564 | A | | 6/1976 | Slovensky | |
| 4,068,871 | A | | 1/1978 | Mercer | |
| 4,199,176 | A | | 4/1980 | Kelly | |
| 4,273,368 | A | | 6/1981 | Tanaka | |
| 4,538,844 | A | | 9/1985 | Watanabe | |
| 4,657,292 | A | * | 4/1987 | Bruck | 292/80 |
| 4,660,654 | A | | 4/1987 | Wiebe et al. | |
| 4,678,212 | A | * | 7/1987 | Rubio | 292/7 |
| 4,784,414 | A | * | 11/1988 | Free | 292/52 |
| 4,862,641 | A | * | 9/1989 | McCarty | 49/394 |
| 4,911,487 | A | | 3/1990 | Rachocki | |
| 4,979,766 | A | | 12/1990 | Wasilewski | |
| 5,040,833 | A | * | 8/1991 | Brunnert | 292/80 |
| 5,820,174 | A | | 10/1998 | Parikh et al. | |
| 5,875,948 | A | | 3/1999 | Sadler | |
| 6,006,560 | A | | 12/1999 | DeVries | |
| 6,079,585 | A | | 6/2000 | Lentini | |
| 6,120,069 | A | | 9/2000 | Taranto | |
| 6,309,008 | B1 | | 10/2001 | Bacon | |
| 6,334,560 | B1 | | 1/2002 | Lentini | |
| 6,378,916 | B1 | | 4/2002 | Huang | |
| 6,454,320 | B1 | | 9/2002 | Weinerman et al. | |
| 6,497,445 | B1 | | 12/2002 | Combs | |
| 6,543,821 | B1 | | 4/2003 | Weinerman et al. | |
| 6,698,258 | B2 | | 3/2004 | Westwinkel | |
| 6,772,613 | B2 | | 8/2004 | Webb et al. | |
| 7,261,328 | B2 | | 8/2007 | Minix | |
| 7,686,207 | B1 | | 3/2010 | Jeffs | |
| 8,403,374 | B2 | | 3/2013 | Shimizu et al. | |

FOREIGN PATENT DOCUMENTS

| | | | |
|---|---|---|---|
| FR | 1465494 | | 11/1965 |
| GB | 1238494 | | 7/1971 |
| JP | 2002201829 | A | 7/2002 |

OTHER PUBLICATIONS

U.S. Appl. No. 14/072,128 Office Action mailed Jan. 13, 2016 (8 pages).

* cited by examiner

SLAM LATCH FOR TOOLBOX

FIELD OF INVENTION

The present invention relates to a slam latch for a storage container, such as a toolbox or storage compartment in or on a vehicle.

SUMMARY OF INVENTION

A slam latch, i.e., a locking mechanism, for a storage container, such as a toolbox or storage compartment in or on a vehicle, such as emergency response vehicles (ambulances, rescue vehicles, fire trucks, etc.), buses, shuttle buses, cargo trucks, vans, pick-up trucks, etc. is described herein. The slam latch may also be used for the doors and lids of stationery housings and compartments, such as an electrical housing or a mechanical housing.

In one embodiment, a locking mechanism assembly is described. The locking mechanism assembly comprises a lock comprising a lock housing, a paddle handle, and a spring loading mechanism, wherein the paddle handle is rotatably engaged to the spring loading mechanism. A rod is in a rotational engagement with the lock, wherein the rod has an offset that interacts with a striker in a locking relationship.

In another embodiment, a storage container is described. A lid is hingedly connected to the container. The storage container comprises a plurality of walls defining or forming the container. The container or the lid comprises a striker. A lock comprises a handle and a spring loading mechanism, wherein the handle is rotatably engaged to the spring loading mechanism. A rod is in a rotational engagement with the lock, and the rod having an offset that interacts with the striker in a locking relationship. The lock allows the storage container to be slammed shut in a single motion.

In another embodiment, a toolbox having a slam latch is described. The toolbox comprises a plurality of walls forming a container having a rim. The container comprises a plurality of strikers proximate the rim. A lock for the container comprises a paddle handle, a spring loading mechanism, and an axle. The lock is in operable or rotational communication with a plurality of rods via the axle, wherein each rod includes a first bend leading to a transition portion and a second bend from the transition portion leading to an offset, and each offset interacts with one of the plurality of strikers in a locking relationship. The spring loading mechanism urges the rods to a locked position. A lid is hingedly connected to the container, wherein the lock is mounted on or into the lid.

DETAILED DESCRIPTION OF EMBODIMENTS

A slam type locking mechanism is described. The locking mechanism allows the storage container to be slammed shut in a single motion. The operator may slam the lid or door to the container using a single hand that is only pressing or pushing the lid or door closed. The operator need not directly manipulate or actuate the locking mechanism (i.e., pull on a handle or twist a knob), while slamming the lid or door shut to a closed position. The pressing or pushing of the lid to the closed position engages the locking mechanism to retain the lid in a closed position.

Figure 1:
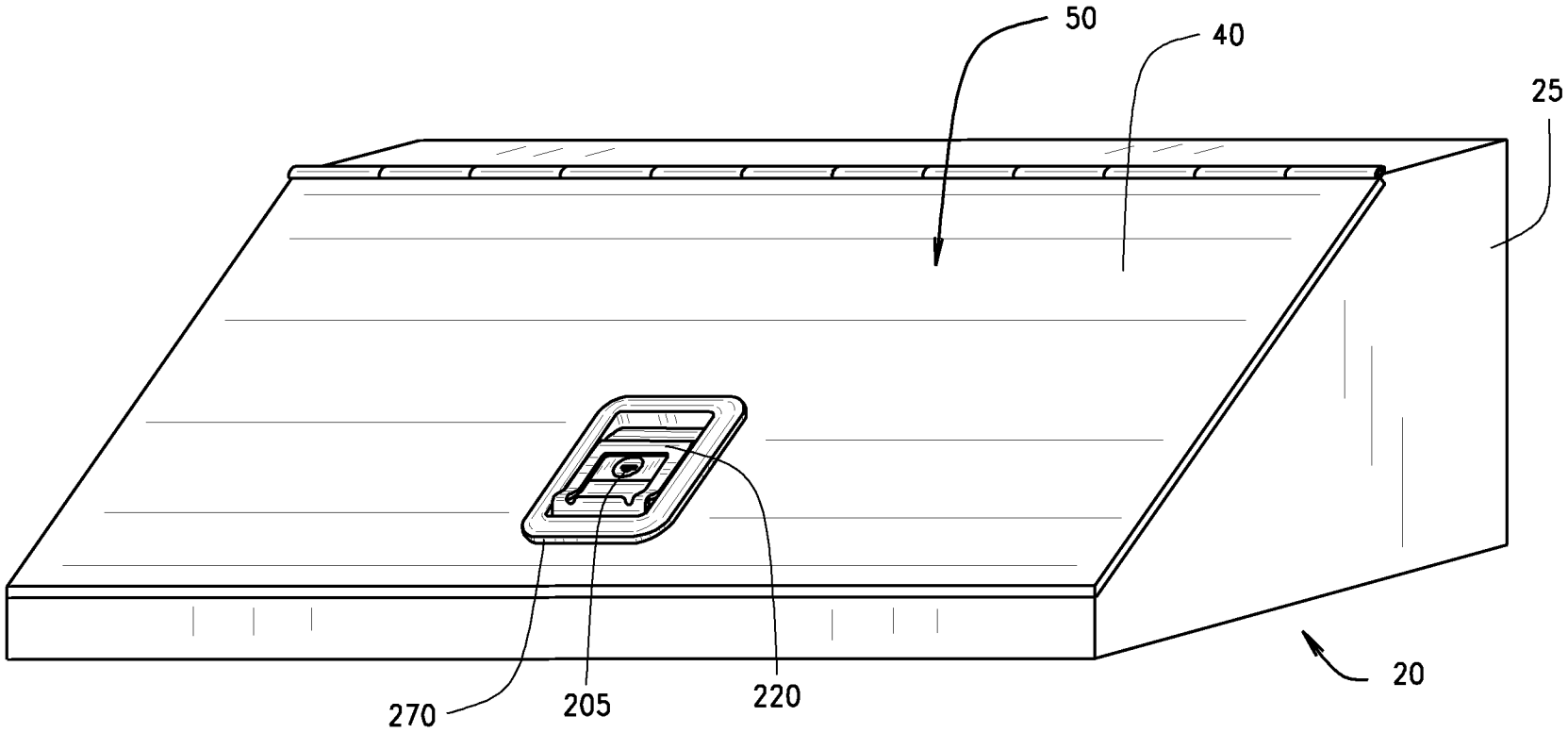
FIG. 1 is a perspective view of a container including the slam latch.
Figure 2:
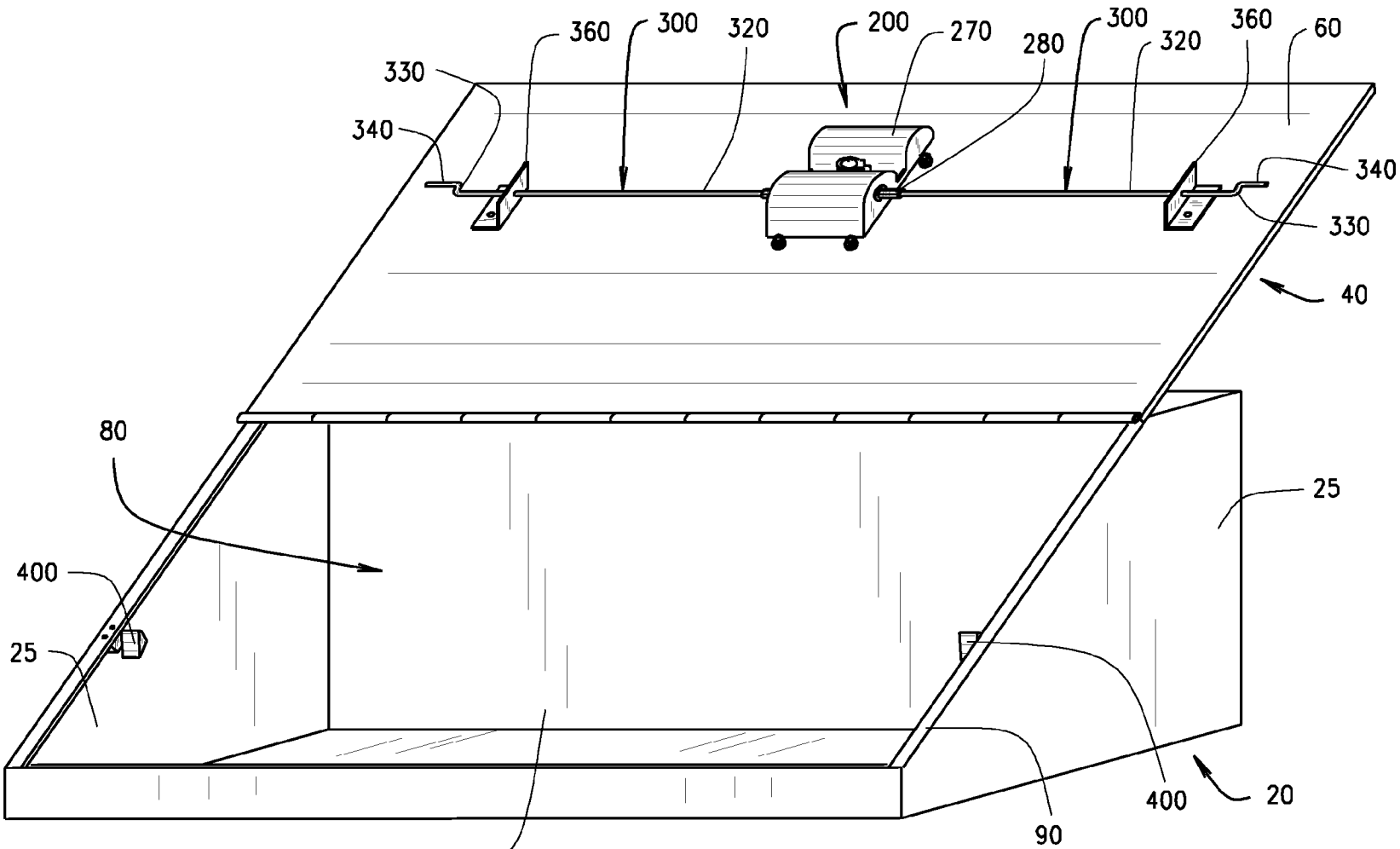
FIG. 2 is a perspective view of the container with the lid in an open position.

As shown in the FIGS. 1 and 2, a container 20 includes a lid 40 with an outer surface 50 and an inner surface 60. The lid 40 is hingeably or openably connected to the container 20. Gas springs, torsion springs, or the like urge the lid 40 to an open position and support the lid 40 in the open position. The container 20 includes a plurality of walls 25 defining a compartment 80 providing a storage area. A container rim 90 defines an opening to the compartment 80.

A locking mechanism assembly 100 for locking the lid 40 in a closed position relative to the container 20 will now be described. The locking mechanism assembly 100 comprises a lock 200 in rotatable engagement with rods 300 that interacts with a plurality of strikers 400 positioned proximate or around the container rim 90 in a locking relationship to lock the lid 40 closed. The rod 300 rotates against and around the strikers 400 to secure the lid 40 in a closed position.

Figure 6:
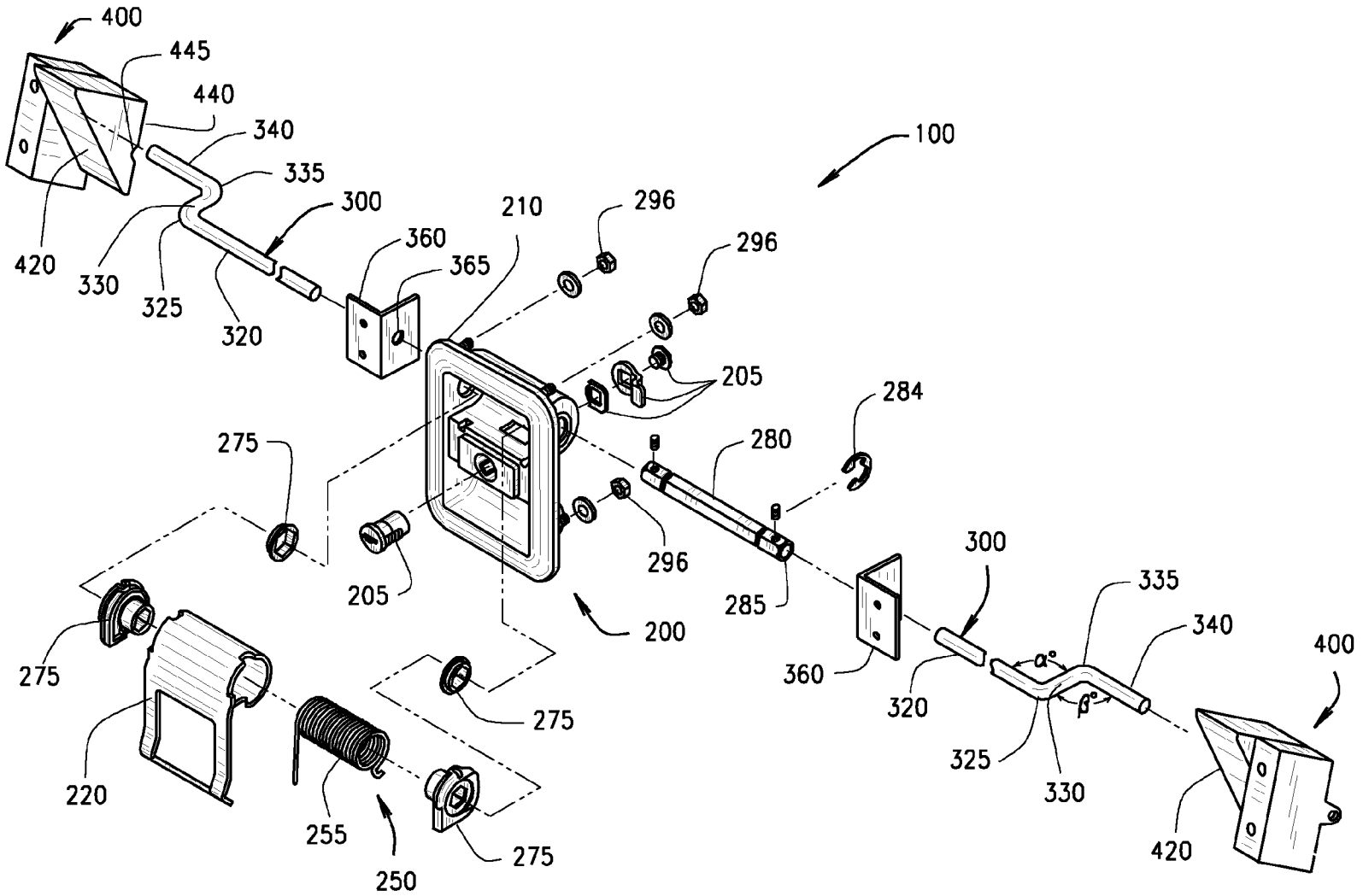
FIG. 6 is an exploded view of the locking mechanism.
Figure 7:
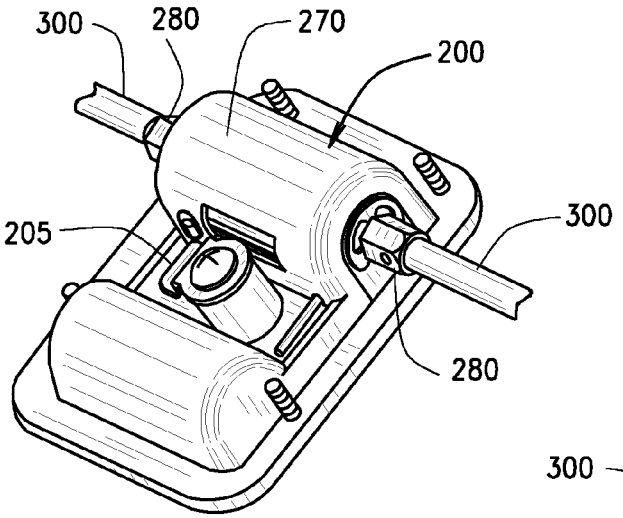
FIG. 7 shows the lock of the locking mechanism in the open position.
Figure 8:
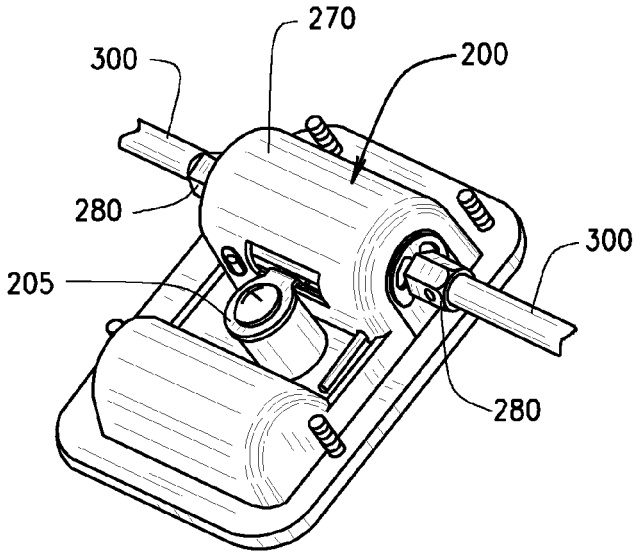
FIG. 8 shows the lock of the locking mechanism in the locked position.
Figure 9:
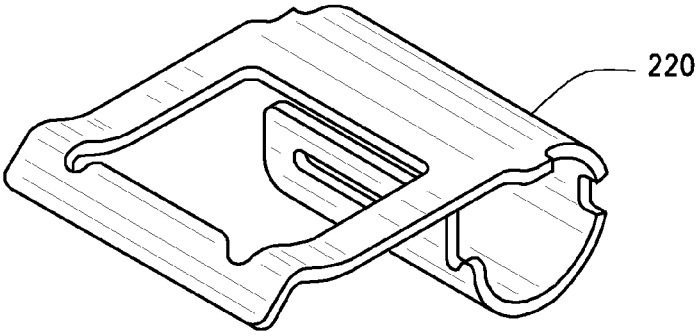
FIG. 9 shows a perspective view of the paddle handle.

With reference to FIG. 6, the lock 200 comprises a paddle handle 220, a lock housing 270, an axle 280, and a spring loading mechanism 250. The spring loading mechanism 250 includes a spring 255. The spring loading mechanism 250 operably connects the paddle handle 220 to the rods 300 via the axle 280. The paddle handle 220 is rotatably engaged to the spring loading mechanism 250 and the axle 280.

The axle 280 connects or attaches the rods 300 to the lock 200. The axle 280 is in rotational communication with the spring loading mechanism 250. Bushings 275 assist in stabilizing and transferring rotational forces of the spring 255 of the spring loading mechanism 250 to the axle 280 and ultimately to the paddle handle 220. The bushings 275 also assist in transferring rotational forces from the axle 280 to the spring 255. The axle 280 may include openings 285 that receive or attach to the rods 300. The axle 280 may also connect directly to the rods 300, or a single rod 300 may replace the axle 280 and be in direct operational communication with the spring loading mechanism 250.

Figures 3, 4, 5:
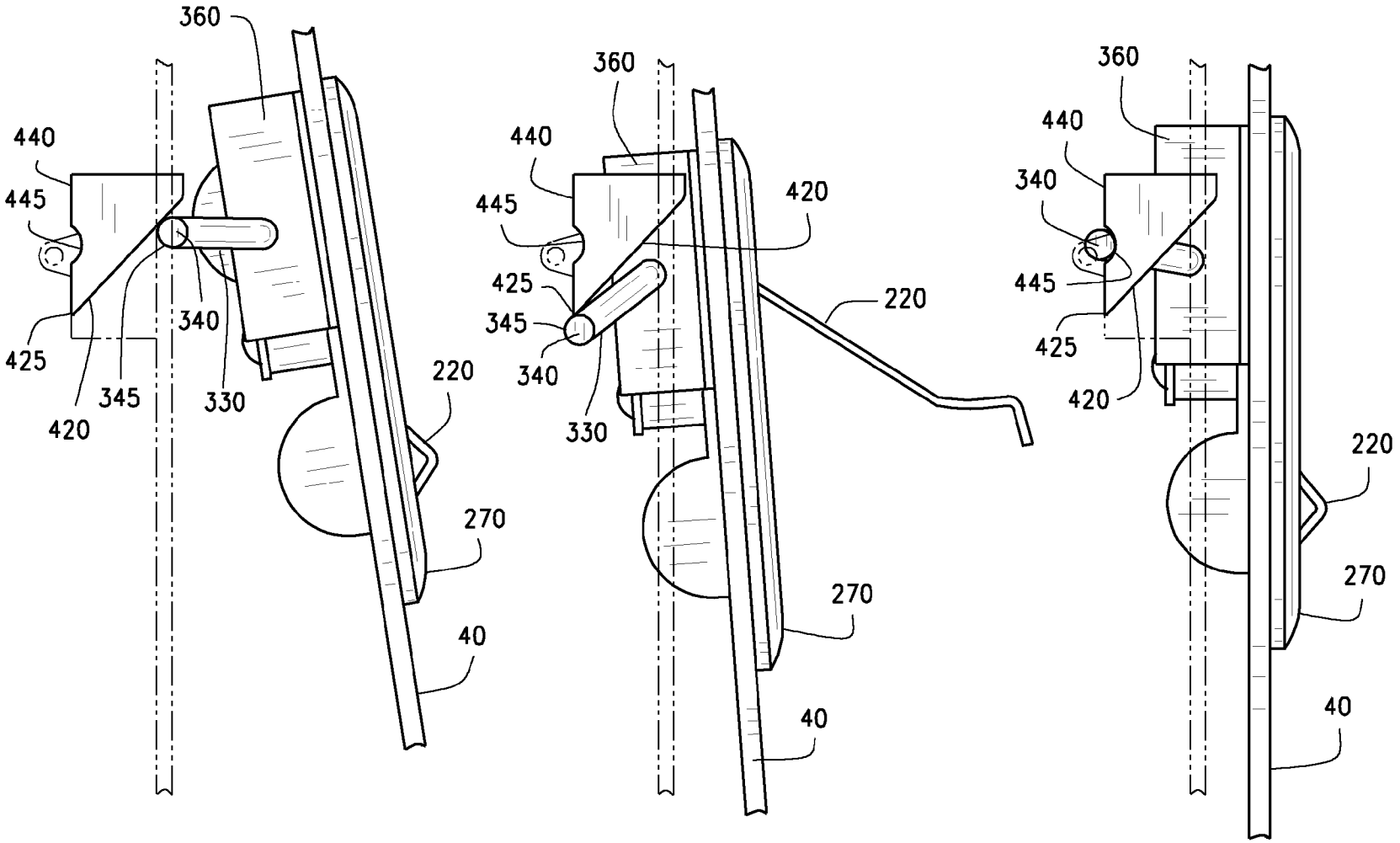
FIG. 3 shows the interaction of the locking mechanism with the striker.
FIG. 4 shows the interaction of the locking mechanism with the striker as the lid is closed.
FIG. 5 shows the interaction of the locking mechanism with the striker when the lid is closed.

As shown in FIGS. 3-5, the operator actuates the paddle handle 220 that is connected to or attached to the rods 300 via the spring loading mechanism 250 to unlock the locking mechanism assembly 100 and open the lid 40 to access the compartment 80. When the operator pulls on the paddle handle 220, the spring loading mechanism 250 translates the pulling force to a rotational force that rotates the rods 300 to disengage the rods 300 from the strikers 400. In some embodiments, the lock 200 may further comprise a key and a locking means 205, such as a bolt, pin, rotating clip, or the like to maintain the lock 200 in a closed and locked position.

The spring loading mechanism 250 in the lock 200 urges the paddle handle 220 towards and to a closed position. When the operator pulls on the paddle handle 220 with sufficient force, the force of the spring loading mechanism 250 on the rods 300 is overcome, and the pulling force on the paddle handle 220 is transferred via the spring loading mechanism 250 to the rods 300, and the rods 300 rotate and the locking mechanism assembly 100 may disengage from the strikers 400.

The rods 300 are generally a linear, metal member including bends and angles, such that the rods 300 engage and disengage the strikers 400 as the rods 300 are rotated. The rods 300 comprises a central axis 320, a transition portion 330, and an offset 340. On the side of the central axis 320 away from the lock 200, the central axis 320 includes a first bend 325 leading to the transition portion 330, and a second bend 335 from the transition portion 330 leading to the offset 340.

The rod 300 and the paddle handle 220 have approximately the same axis of rotation. The locking motion of the locking mechanism assembly 100 latch and unlatch the lock 200 on one central axis.

In the embodiment shown, the first bend 325 has an angle $\alpha$ of approximately 110 to approximately 130 degrees between the central axis 320 and the transition portion 330. The second bend 335 also has an angle $\beta$ of approximately 110 degrees to approximately 130 degrees between the transition portion 330 and the offset 340. The angle $\alpha$ of the second bend 335 is generally opposite to the angle $\beta$ of the first bend 325. As such, the offset 340 and the central axis 340 are generally in a parallel configuration.

The locking mechanism assembly 100 is generally attached or mounted integral to the lid 40, such as by the nuts 296. The locking mechanism assembly 100 includes the lock housing 270. Typically, as shown in the figures, the locking mechanism assembly 100 is positioned with the paddle handle 220 extending from the lock housing 270, while the lock housing 270 is mounted on or into the lid 40. The lock housing 270 contains the spring loading mechanism 250. The rods 300 connect with the axle 280, which extends into through the lock housing 270 on the inner surface 60 side of the lid 40. As such, the paddle handle 220 is exterior to the toolbox 20 and is readily accessible when the lid 40 is in a closed position.

The rods 300 are further supported in a rotational engagement by brackets 360. The brackets 360 include a hole 365. The rod 300 extends through the hole 365 in the bracket 360. As the brackets 360 are positioned proximate the strikers 400, the brackets 360 provide a reinforcing structure for the locking mechanism assembly 100.

A plurality of strikers 400 are positioned around the container rim 90 to interact in a locking arrangement with the offsets 340. The strikers 400 are mounted in a stationary relationship relative to the container 20 and the rim 90. In the embodiment shown, two strikers 400 engage and disengage with the offsets 340 of the rods 300. The strikers 400 are positioned on opposite sides of the container 20.

The strikers 400 comprise a contact surface 420 and a locking surface 440. The contact surface 420 is a generally planar surface. The locking surface 440 includes an optional notch 445 that holds the diameter of the offset 340. In other embodiments, the locking surface 440 includes a plurality of the optional notches 445.

In a closing action of the lid 40, an outer periphery 345 of the offset 340 contacts the contact surface 420 of the striker 400, and the offset 340 rotates as it slides on the contact surface 420 of the striker 400, compressing the spring loading mechanism 250 until the offset 340 reaches an end 425 of the contact surface 420, and the offset 340 then snaps under the striker 400, by the action of the spring loading mechanism 250, to a resting position on the locking surface 440 on a rear side of the striker 400. In the closing action of the lid 40, the operator need only slam the lid 40 shut, as there is no need to actuate the paddle handle 220. As described, the contact of the outer periphery 345 of the offset 340 to the contact surface 420 of the striker 400 causes the offset 340 to rotate. This contact of the offset 340 to the contact surface 420 overcomes the force of the spring loading mechanism 250 in the lock 200 causing the offset 340, and consequently to the rod 300, to rotate and compress the spring loading mechanism 250 until the offset 340 reaches the end 425 of the contact surface 420.

When the lid 40 is already in a closed position and the operator desires to open the lid 40, the operator pulls on the paddle handle 220, which rotates the rod 300 and its offset 340. The offset 340 is rotated from the locking surface 440 around the striker 400, thus releasing the locking mechanism assembly 100 such that the lid 40 may be opened.

The locking mechanism assembly 100 provides two contact points, i.e., the strikers 400 on either side of the lid 40. This provides increased security.

The rods 300 may rotate up to approximately 80 to approximately 85 degrees. In this embodiment, this amount of rotation of the rod 300 provides for the offset 340 to slide on the contact surface of the striker 400 and then snap under the striker 400. In other embodiments, the rods 300 may rotate up to approximately 150 or to approximately 180 degrees, depending upon the interface between the offset 340 and the striker 400. The amount of rotation needed will vary depending on the length of the transition portion 330, the size and shape of the striker 400, etc.

Although a paddle handle 220 is shown in the Figures, other handles, pulls, knobs, etc. may be used with the present invention to rotate the rod 300 to engage and disengage the rods 300 from the strikers 400.

The container 20 may be made from a variety of materials, including stainless steel, metals, and metal alloys. In other embodiments, the container 20 employing the locking mechanism assembly 100 may be made from rigid plastic materials. Although the locking mechanism assembly 100 has been described with reference to the container, which may be a toolbox 20, other storage containers, lockers, electrical service enclosures, cabinets may employ the locking mechanism assembly 100.

In alternative embodiments, the locking mechanism 100 is configured with the lock 200 attached or mounted to the container 20. The rods 300 extend toward the walls 25 of the container 20. The strikers 400 are attached or mounted to the lid 40 in a fixed position. As the lid 40 closes, the strikers 400 are urged against the rods 300 in order secure the lid 40. Although the configuration of the lock mechanism 100 is now reversed, the locking mechanism 100 operates similarly to other the embodiments described herein.

Those skilled in the art will appreciate that variations from the specific embodiments disclosed above are contemplated by the invention. The invention should not be restricted to the above embodiments, but should be measured by the following claims.

What is claimed:

1. A locking mechanism assembly, comprising:

a lock comprising a lock housing, a handle, and a spring loading mechanism, wherein the handle is rotatably engaged to the spring loading mechanism;

a fixed striker comprising a generally triangular shape that comprises a generally planar contact surface on a front of the striker, a generally planar locking surface on a rear of the striker, and a generally planar top surface, wherein the contact surface extends in an angled direction from a first end of the top surface and joins the locking surface, wherein the contact surface forms an acute angle relative to the locking surface; wherein the locking surface extends from a second end of the top surface in a direction orthogonal to the top surface;

a rod in a rotational engagement with the lock, wherein the rod has an offset that interacts with the striker in a locking relationship; and, the offset contacts the contact surface of the striker and the offset rotates as it slides on the contact surface of the striker and compresses the spring loading mechanism until the offset reaches an end of the contact surface on the front of the striker, and the offset rotates and snaps around the end of the contact surface of the striker to a locking position on the locking surface on the rear of the striker, wherein a body of the striker is between the offset and the contact surface in the locking position.

2. The locking mechanism assembly of claim 1, wherein the striker includes the generally planar contact surface, and the offset rotates against the generally planar contact surface.

3. The locking mechanism assembly of claim 1, wherein the rod comprises a central axis, a transition portion, and the offset.

4. The locking mechanism assembly of claim 3, wherein the rod includes a first bend leading to the transition portion and a second bend from the transition portion leading to the offset.

5. The locking mechanism assembly of claim 1, wherein the offset contacts the contact surface of the striker and the offset rotates as it slides on the contact surface of the striker and compresses the spring loading mechanism until the offset reaches the end of the contact surface and snaps around the striker to a recess in the locking surface of the striker.

6. The locking mechanism assembly of claim 1, wherein the offset contacts the contact surface of the striker and the offset rotates as it slides on the contact surface of the striker and compresses the spring loading mechanism until the offset reaches the end of the contact surface and snaps to a resting position on the locking surface of the striker.

7. The locking mechanism assembly of claim 1, wherein the rod comprises two rods, wherein the lock is rotatably engaged with the two rods, wherein the spring loading mechanism comprises a spring, and the spring loading mechanism operably connects the handle to the rods via an axle.

8. The locking mechanism assembly of claim 1, wherein the spring loading assembly urges the locking mechanism assembly to a closed position.

9. The locking mechanism assembly according to claim 1, wherein the rod rotates up to approximately 80 or 85 degrees.

10. The locking mechanism assembly according to claim 1, wherein the rod rotates up to approximately 150 or 185 degrees.

11. A locking mechanism assembly, comprising:

a lock comprising a lock housing, a paddle handle, and a spring loading mechanism, wherein the paddle handle is rotatably engaged to the spring loading mechanism; and a rod in a rotational engagement with the lock, wherein the rod has an offset that interacts with a fixed striker in a locking relationship, the striker comprising a mounting portion and a striker body attached to the mounting portion, the striker body comprises a generally triangular shape that comprises a contact surface, a locking surface opposite of the contact surface, and a generally planar top surface, wherein an end of the offset contacts the contact surface of the striker and the end of the offset rotates as it slides on the contact surface of the striker and compresses the spring loading mechanism until the end of the offset reaches an end of the contact surface and the end of the offset rotates under the striker by the action of the spring loading mechanism, to a resting position on the locking surface of the striker, wherein the body of the striker is between the offset and the contact surface in the resting position, wherein the locking surface joins the contact surface and extends in an angled direction from the contact surface, wherein the contact surface forms an acute angle relative to the locking surface and the contact surface extends in an angled direction from a first end of the top surface; and wherein the locking surface extends from a second end of the top surface in a direction orthogonal to the top surface.

12. A storage container, comprising:

a plurality of walls defining or forming a container, the container comprising a fixed striker engaged to the walls;

the striker comprising a mounting portion and a striker body attached to the mounting portion, the striker body comprising a generally triangular shape that comprises a contact surface on a front of the striker, a locking surface on a rear of the striker, and a generally planar top surface, wherein the contact surface extends in an angled direction from a first end of the top surface and the contact surface extends in an angled direction from the locking surface; wherein the contact surface forms an acute angle relative to the locking surface; wherein the locking surface extends from a second end of the top surface in a direction orthogonal to the top surface;

a lock comprising a handle and a spring loading mechanism, wherein the handle is rotatably engaged to the spring loading mechanism;

a rod in a rotational engagement with the lock, the rod having an offset that interacts with the striker in a locking relationship;

a lid hingedly connected to the container; and, the offset contacts the contact surface of the striker and the offset rotates as it slides on the contact surface on the front of the striker and compresses the spring loading mechanism until the offset reaches an end of the contact surface, and the offset rotates and snaps around the end of the contact surface of the striker to a locking position on the locking surface on the rear of the striker, wherein the body of the striker is between the offset and the contact surface in the locking position.

13. The storage container according to claim 12, wherein the handle translates a pulling force to a rotational force that rotates the rod.

14. The storage container according to claim 12, wherein the offset of the rod rotates against and around the striker to secure the lid in a closed position.

15. The storage container according to claim 12, wherein the lock is in operational communication with two rods and two strikers, and the strikers are positioned on opposite sides of the container.

16. The storage container according to claim 15, where each of the two rods pass through brackets mounted on the lid.

17. The storage container according to claim 12, wherein pushing the lid to a closed position on the container actuates the lock to a locked position which maintains the lid in the closed position.

18. The storage container according to claim 12, wherein a pulling force on the handle overcomes the spring loading mechanism and rotates the rod to an open position for opening the lid.

19. The storage container according to claim 12, wherein a pulling force on the handle overcomes the spring loading mechanism and rotates the rod and its offset from the locking surface of the striker and around the striker.

20. The storage container according to claim 12, wherein the spring loading mechanism urges the lock to a closed position.

21. A storage container, comprising:

a plurality of walls defining or forming a container, the container comprising a fixed striker fixed to the walls;

the fixed striker comprising a mounting portion and a striker body integral to the mounting portion, the striker body comprises a generally triangular shape that comprises a contact surface, a locking surface, and a generally planar top surface wherein the contact surface extends in an angled direction from a first end of the top surface, and the locking surface extends from a second end of the top surface in a direction orthogonal to the top surface, and the locking surface connects to the contact surface;

a lock comprising a handle and a spring loading mechanism, wherein the handle is rotatably engaged to the spring loading mechanism;

a rod in a rotational engagement with the lock, the rod having an offset that interacts with the striker in a locking relationship; and, a lid hingedly connected to the container, wherein the offset contacts a contact surface of the striker and the offset rotates as it slides on the contact surface of the striker and compresses the spring loading mechanism until the offset reaches an end of the contact surface, and the offset rotates and snaps under the striker by the action of the spring loading mechanism, and a whole end of the offset snaps and rotates to a resting position on the locking surface of the striker, wherein the body of the striker is between the whole end of the offset and the contact surface in the resting position, wherein the locking surface extends at an acute angle from the contact surface.

22. A toolbox having a slam latch, comprising:

a plurality of walls defining or forming a container having a rim, the container comprising a plurality of fixed strikers proximate the rim in a stationary configuration;

the strikers comprising a mounting portion and a striker body attached to the mounting portion, the striker body comprises a generally triangular shape that comprises a contact surface, a locking surface opposite of the contact surface, and a top surface, wherein the locking surface is on a rear of the striker body, wherein the contact surface extends in an angled direction from the locking surface, wherein the contact surface extends in an angled direction from a first end of the top surface, and the locking surface extends from a second end of the top surface in a direction orthogonal to the top surface, and the locking surface connects to the contact surface;

a lock comprising a paddle handle, a spring loading mechanism, and an axle;

a plurality of rods in rotational engagement with the lock via the axle, wherein each rod includes a first bend leading to a transition portion and a second bend from the transition portion leading to an offset, and each offset interacts with one of the plurality of strikers in a locking relationship;

the spring loading mechanism urging the rods to a locked position; and, a lid hingedly connected to the container, wherein the lock is mounted on or into the lid; and the offset contacts the contact surface of the striker and the offset rotates as it slides on the contact surface on the front of the striker and compresses the spring loading mechanism until the offset reaches an end of the contact surface, and the offset rotates and snaps around the end of the striker to a locking position on the locking surface on a rear of the striker, wherein the body of the striker is between the offset and the contact surface in the locking position.

23. A storage container, comprising:

a plurality of walls defining or forming a container, the container comprising a lid hingedly connected to the container;

a plurality of strikers, the strikers comprising a mounting portion and a striker body attached to the mounting portion, the striker body has a triangular shape that comprises a top surface, a contact surface, and a locking surface, wherein the contact surface extends in an angled direction from a first end of the top surface, and the locking surface extends from a second end of the top surface in a direction orthogonal to the top surface, and the locking surface connects to the contact surface, and the locking surface includes a locking recess;

a lock comprising a handle and a spring loading mechanism, wherein the handle is rotatably engaged to the spring loading mechanism;

rods in a rotational engagement with the lock, the rods having offsets that rotatably interact with the strikers in a locking relationship to secure the lid; and, the offset contacts the contact surface of the striker and the offset rotates as it slides on the contact surface of the striker and compresses the spring loading mechanism until the offset reaches an end of the contact surface, and the offset rotates and snaps into the recess in the locking surface of the striker.

24. A locking mechanism assembly, comprising:

a lock comprising a rod, a striker, and a spring loading mechanism, wherein the rod is rotatably engaged to the spring loading mechanism wherein the rod has an offset that interacts with the striker in a locking relationship;

the striker comprising a mounting portion and a striker body attached to the mounting portion, the striker body has a triangular shape that comprises a top surface, a contact surface, and a locking surface, wherein the contact surface includes a generally planar portion, wherein the contact surface extends in an angled direction from a first end of the top surface, and the locking surface extends from a second end of the top surface in a direction orthogonal to the top surface, and the locking surface connects to the contact surface, and the locking surface includes a locking recess; and, the offset contacts the contact surface of the striker and the offset rotates as it slides on the contact surface of the striker and compresses the spring loading mechanism until the offset reaches an end of the contact surface and the spring loaded mechanism urges the offset to rotate around the striker to the locking recess of the of the locking surface of the striker.

25. A locking mechanism assembly, comprising:

a lock comprising a lock housing, a handle, and a spring loading mechanism, wherein the handle is rotatably engaged to the spring loading mechanism;

a fixed striker comprising a mounting portion and a striker body attached to the mounting portion, the striker body comprises a generally triangular shape that comprise a generally planar contact surface, a generally planar locking surface, and a generally planar top surface, wherein the generally planar locking surface is on a rear of the striker body, wherein the contact surface extends in an angled direction from a first end of the top surface, and wherein the contact surface forms an acute angle relative to the locking surface; and wherein the locking surface extends from a second end of the top surface in a direction orthogonal to the top surface;

a rod in a rotational engagement with the lock, wherein the rod has an offset that interacts with the striker in a locking relationship; and, the offset contacts the contact surface of the striker and the offset rotates as it slides on the contact surface on the front of the striker and compresses the spring loading mechanism until the offset reaches an end of the contact surface and the spring loaded mechanism urges the offset to rotate around the end of the contact surface to a recess in the generally planar locking surface on the rear of the striker, wherein the body of the striker is between the offset and the contact surface in the locking position, and the offset is seated in the recess.

* * * * *